US005143445A

United States Patent [19]

Bateman et al.

[11] Patent Number: 5,143,445

[45] Date of Patent: Sep. 1, 1992

[54] GLASS REFLECTORS LPCVD COATED WITH OPTICAL INTERFERENCE FILM

[75] Inventors: Robert L. Bateman, Chagrin Falls; Thomas G. Parham, Mayfield Village, both of Ohio

[73] Assignee: General Electric Company, Schenectady, N.Y.

[21] Appl. No.: 419,233

[22] Filed: Oct. 10, 1989

[51] Int. Cl.[5] ..... F21V 7/22

[52] U.S. Cl. ..... 362/293; 362/341; 362/296; 362/255; 313/112

[58] Field of Search ..... 362/255, 293, 331, 296, 362/346, 341, 297; 313/112, 113, 114, 116; 350/164

[56] References Cited

U.S. PATENT DOCUMENTS

| | | | |
|---|---|---|---|
| 2,552,185 | 5/1951 | Koch | 362/261 |
| 3,288,989 | 11/1966 | Cooper | 362/226 |
| 3,527,974 | 9/1970 | Cooper | 313/113 |
| 4,021,659 | 5/1977 | Wiley | 362/297 |
| 4,315,186 | 2/1982 | Hirano et al. | 313/112 |
| 4,420,801 | 12/1983 | Reiling et al. | 362/375 |
| 4,604,680 | 8/1986 | Levin et al. | 362/293 |
| 4,663,557 | 5/1987 | Martin, Jr. et al. | 313/112 |
| 4,701,663 | 10/1987 | Kawakatsu et al. | 313/112 |
| 4,775,203 | 10/1988 | Vakil et al. | 350/1.7 |
| 4,785,383 | 11/1988 | Tarnoz | 362/296 |
| 4,833,576 | 5/1989 | Mers et al. | 362/226 |
| 4,839,553 | 6/1989 | Mellor | 313/113 |
| 4,870,318 | 9/1989 | Csanyi et al. | 313/112 |
| 4,983,001 | 1/1991 | Hagiuda et al. | 350/1.6 |

*Primary Examiner*—Ira S. Lazarus

*Attorney, Agent, or Firm*—Edward M. Corcoran; Stanley C. Corwin; Fred Jacob

[57] ABSTRACT

An all glass reflector having a front reflecting surface and terminating in the rear in a cavity into which a lamp is cemented transmits substantially less light out of the rear when at least the inside or the outside of the cavity and the reflecting surface are coated with an optical interference coating. The coating is applied by a low pressure chemical vapor deposition process.

33 Claims, 2 Drawing Sheets

Fig. 1
(PRIOR ART)
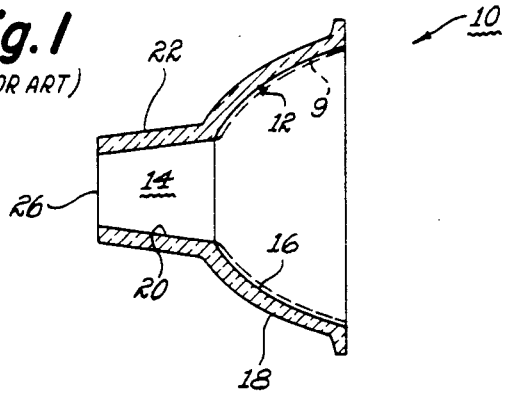
Fig. 2(b)
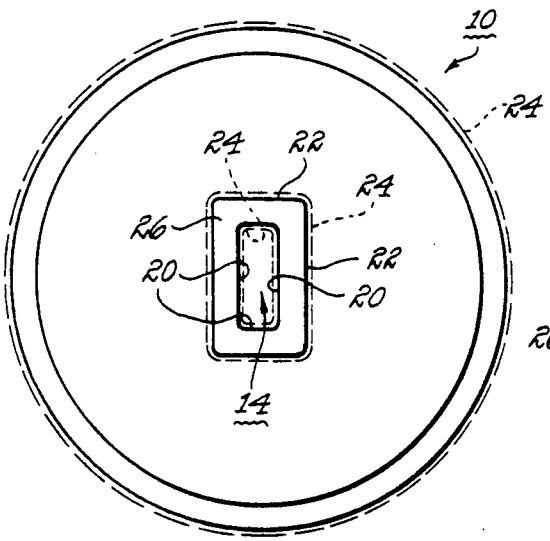
Fig. 2(a)
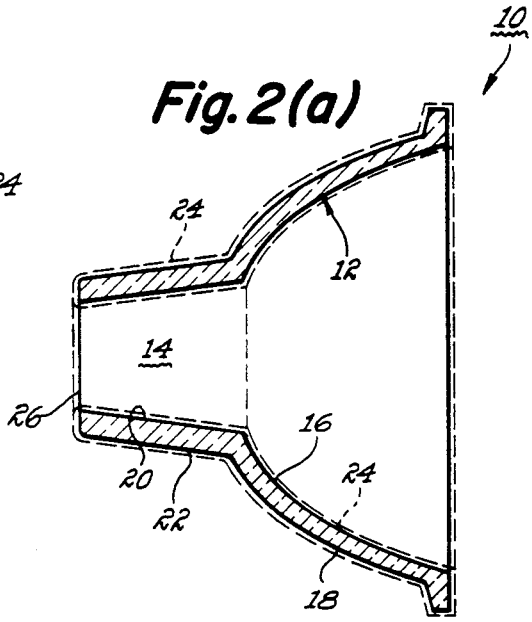
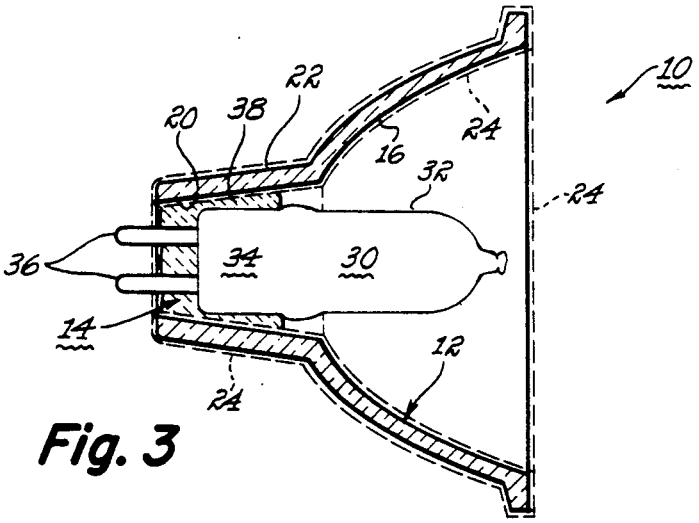
Fig. 3

GLASS REFLECTORS LPCVD COATED WITH OPTICAL INTERFERENCE FILM

BACKGROUND OF THE INVENTION

1. Field of the Invention

This invention relates to a glass reflector coated on both sides with an optical interference film. More particularly this invention relates to all glass reflectors and their use with lamps, wherein both the inside and the outside surfaces of the reflector are coated with an optical interference film deposited by a low pressure chemical vapor deposition process.

2. Background of the Disclosure

Thin film optical interference coatings known as interference filters or optical interference films which comprise alternating layers of two or more materials of different refractive index are well known to those skilled in the art. Such coatings or films are used to selectively reflect and/or transmit light radiation from various portions of the electromagnetic spectrum such as ultraviolet, visible and infrared radiation. These films or coatings are used in the lamp industry to coat reflectors and lamp envelopes. One application in which these coatings have been found to be useful is to improve the illumination efficiency or efficacy of incandescent and arc lamps by reflecting infrared radiation emitted by a filament or arc back to the filament or arc while transmitting the visible light portion of the electromagnetic spectrum emitted by the filament or arc. This lowers the amount of electrical energy required to be supplied to the filament or arc to maintain its operating temperature. Such films have also been applied to reflectors in the form of what is known in the art as cold mirrors. A cold mirror in the prior art is a glass or plastic reflector coated on the inside reflecting surface with an optical filter which reflects visible light thereby projecting it forward of the reflector, while at the same time permitting longer wavelength infrared energy to pass through the coating and the reflector. This insures that the light projected forward by the reflector is much cooler than it would otherwise be if both the visible and the infrared light were reflected and projected forward. On the other hand, some reflectors contain a completely reflecting coating on the inside reflecting surface, such as aluminum or optical interference coating, for reflecting all of the radiation emitted by the lamp filament or arc and projecting same forward of the reflector. In this latter case, the projected light is significantly hotter than that obtained with a cold mirror.

One of the problems that has been encountered results from the processes, such as vacuum sputtering and reactive plasma or electron beam evaporation, employed to coat reflectors. In these types of processes, it is difficult and sometimes impossible to coat articles having complex shapes, because these processes are line-of-sight processes or approximately line-of-sight processes. With all glass reflectors having a rearwardly protruding socket cavity or nose portion into which a lamp is cemented, these prior art coating processes have been unable to coat the surface of the cavity and this has resulted in a significant amount of bright, white visible light being projected out through the rear socket portion of the reflector.

SUMMARY OF THE INVENTION

The present invention relates to a light transparent reflector, such as an all glass or plastic reflector, comprising a front reflecting portion having a light reflecting surface and a rear portion, wherein said rear portion terminates in an elongated, rearwardly protruding cavity for receiving a portion of a lamp, said reflector being coated on both the reflecting surface and on the inside or outside surface, or both, of the rear portion with an optical interference coating for selectively reflecting and transmitting desired portions of the electromagnetic spectrum. By optical interference coating is meant a multi-layer coating comprising alternating layers of both high and low index of refraction materials. In a preferred embodiment the coating is applied by a low pressure chemical vapor deposition process (LPCVD). In another embodiment, all of both the interior and exterior surfaces of the reflector are coated with an optical interference film. Another embodiment of this invention relates to such coated reflectors in combination with lamps. Lamp and reflector combinations in accordance with this invention transmit substantially less light out through the rear of the reflector. In an embodiment of this invention, the optical interference coating is designed so that light which is transmitted through the reflector is of a pleasing, uniform, subdued color which is not harsh to the human eye. Reflectors have been made according to the invention which appear blue, gold, green, etc., when viewed from the rear or side with white light projected forward of the reflector.

BRIEF DESCRIPTION OF THE DRAWINGS

FIG. 1 schematically illustrates an all glass reflector with an optical coating only on the interior reflecting surface and represents the prior art.

FIGS. 2(*a*) and 2(*b*) schematically illustrate an embodiment of the present invention.

FIG. 3 schematically illustrates a reflector in accordance with the present invention in combination with a lamp.

DETAILED DESCRIPTION

Figure 4:
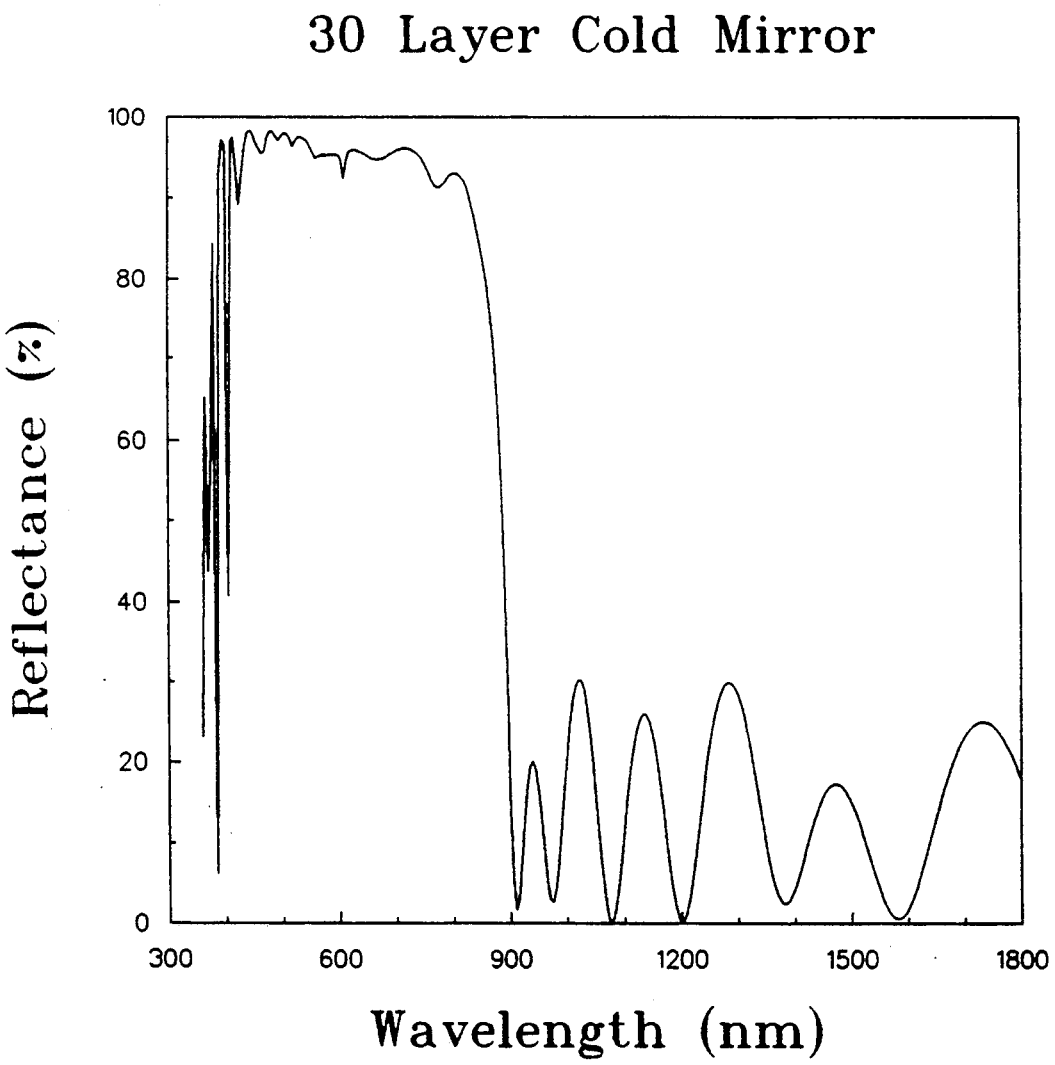
FIG. 4 illustrates the theoretical spectral reflectance and transmittance of an optical interference coating applied to reflectors according to the invention.

FIG. 1 schematically illustrates an all glass reflector 10 having a parabolic reflecting portion 12 at one end with the other end terminating in an elongated cavity portion 14 for receiving a lamp. The parabolic reflecting portion has internal and external surfaces 16 and 18, respectively, and the elongated rear portion has an internal surface 20 defining a cavity therein, an external surface 22 and an end surface 26. As shown in FIG. 1, only the internal reflecting surface of the parabolic reflecting portion 12 is coated with an optical interference coating 9. Coating 9 may be either a metal or a cold mirror type as described above. Coating 9 is generally either aluminum or silver metal which is vacuum deposited or sputtered or an optical interference coating consisting of alternating layers of high and low refractive index material designed to make up the filter desired for projecting light forward of the reflector from a lamp source (not shown) held in the reflector by being cemented into cavity 14 (c.f., FIG. 3) with the optical center of the lamp at the focal point of the reflector. Optical interference coatings in the prior art have been applied by vacuum deposition, sputtering, and plasma or electron beam reactive processes. All of these processes are line-of-sight or nearly line-of-sight processes which, as a natural consequence of the process, cannot coat the interior surface 20 of cavity 14. One such process is disclosed in U.S. Pat. No. 4,663,557 wherein a vacuum deposition chamber utilizing standard vacuum coating technology is employed to apply a coating to the outer surface of a lamp envelope. In this process either an electron beam or a resistance heater is used as an evaporation source to evaporate the metal or metal oxide onto the substrate and, at the same time, oxygen is bled into the reaction or deposit in chamber in order to form a metal oxide on the substrate. Bleeding oxygen or other reactive gas into the chamber results in a slight amount of scatter in the depositing material off its line-of-sight path. This patent discloses this method for applying optical interference coatings consisting of alternating layers of silica and tantala to the exterior surface of a lamp envelop for reflecting infrared energy back to the filament.

As a consequence of these prior art processes for applying optical interference coatings to reflectors not being able to coat the interior surface 20 of the elongated rearward cavity portion 14 of reflector 10, a significant and substantial amount of visible light escapes through the glass (or plastic) defined between surfaces 20 and 22 of rear cavity 14 and into the surrounding. In many applications of lamp and reflector combinations of this type, the lamp/reflector combination is held in a fixture in which the entire combination is visible and the light exiting through the rear cavity portion has been found to be annoying and a nuisance in many cases. Coating the exterior surface 22 of cavity 14 with an opaque, heat resistant paint mars its appearance and can result in too much heat build up in the cavity which can crack the reflector and also cause lamp failure due to oxidation of lamp leads cemented in the cavity (c.f., FIG. 3). Filling the cavity with cement also results in too much heat build up with concomitant lamp failure and/or reflector cracking as well as effecting the coherence of the light reflected and projected forward of the reflector.

Turning now to FIG. 2(*a*), there is schematically shown an all glass reflector coated with an optical interference filter on all surfaces in accordance with one embodiment of the present invention. Thus, all glass reflector 10 comprising parabolic front reflecting portion 12 and rearwardly projecting cavity 14 is coated on all surfaces with optical interference film 24. Thus, both the internal and external surfaces 16 and 18, respectively, of parabolic reflecting portion 12 are coated with an optical interference film 24 which film is coherent and continuous around the reflecting inner surface 16 of the parabolic reflecting portion and interior surface 20 of cavity 14, around end 26 and exterior surfaces 22 and 18 of cavity 14 and parabolic reflecting portion 12, respectively FIG. 2(*b*) is an end view of reflector 10 shown in FIG. 2(*a*) illustrating the exterior surface 22 of cavity 14 and the interior surface 20 thereof coated with optical interference coating 24. In another embodiment of the invention, just the interior surfaces 16 and 20 of the parabolic reflecting portion 12 and cavity 14, respectively, will be coated which will be sufficient to substantially reduce most of the light from exiting through the glass defined between interior and exterior surfaces 20 and 22, respectively, of cavity 14. In another embodiment which is that depicted in FIG. 2, all of the interior and exterior surfaces of reflector 10 are coated with optical interference coating 24. In yet another embodiment, for manufacturing or other reasons it may be desirable after applying the coating to both the interior and exterior surfaces of reflector 10 to remove coating 24 from the rear end edge portion 26 of cavity 14. This will not make a significant difference in the context of the present invention with regard to light escaping out through cavity 14. As set forth above, in the present invention the reflecting surface and at least the interior or exterior surface of cavity 14 are coated with an optical interference coating. However, the embodiment illustrated in FIG. 2 wherein all surfaces are coated is particularly preferred.

Turning now to FIG. 3 there is schematically illustrated lamp 30 comprising a vitreous envelope 32 hermetically sealed at 34 by means of a customary pinch seal or shrink seal and having exterior leads 36, wherein said lamp is cemented into cavity 14 by cement 38. Lamp and reflector combinations of this type, but having an optical interference coating only on the interior reflecting surface, are known to those skilled in the art as are suitable cements for securing the lamp in the reflector. U.S. Pat. No. 4,833,576, the disclosures of which are incorporated herein by reference, discloses such lamp and reflector combinations and cement for cementing the lamp in the reflector which are useful in the practice of the present invention. Lamp 30 also contains a filament and inleads or an arc (not shown) within envelope 32. When energized, lamp 30 emits light most of the visible portion of which is reflected by coating 24 on the interior surface 16 of parabolic reflecting portion 12. If the coating is only on the interior surface 16 some of the visible light escapes out through the cavity portion now shown containing lamp 30 and cement 38 holding lamp 30 in place in the reflector. If a coating isn't on the interior or exterior surface 20 or 22, respectively, of cavity 14 a significant amount of the light emitted by the lamp is transmitted through the side walls of the cavity. In the embodiment shown in FIG. 3, all of the surfaces interior and exterior of reflector 10 are coated with an optical interference coating for transmitting infrared radiation and reflecting visible light in the range it is desired to have reflected and projected forwardly of the reflector, with extremely little visible light exiting through the glass of rear cavity portion 14. As set forth above, the coating may be just on the interior surface 20 of cavity 14 or it may be just on the exterior surface 22 thereof. However, in the embodiment shown in FIG. 3 optical interference coating 24 completely coats all exterior and interior surfaces of reflector 10.

Applying a coating to the interior and/or exterior surfaces of reflector 10 is accomplished in a facile manner employing a low pressure vapor deposition (LPCVD) coating process for applying alternating layers of high and low refractive index materials. In an LPCVD process a suitable metal oxide precursor reagent or reagents for each material of the film is separately introduced into a decomposition chamber wherein it is decomposed or reacted to form the metal oxide on a heated substrate. Separate layers of, for example, silica and tantala or titania are applied onto the substrate in this fashion until the desired filter is achieved. Such chemical vapor deposition techniques are well known to those skilled in the art and are disclosed in, for example, U.S. Pat. Nos. 4,006,481; 4,211,803; 4,393,097; 4,435,445; 4,508,054; 4,565,747 and 4,775,203. In forming the alternating layers of titania (or tantala) and silica on a glass reflector in accordance with the present invention, the reflector is positioned within a deposition chamber. The chamber is generally contained within a furnace so that the object reaches the desired temperature to achieve the reaction or decomposition and concomitant deposition of the titania or silica film on the object. These temperatures will generally range between about 350°-600° C., depending upon the particular reagent used. For an LPCVD process, the deposition chamber is evacuated and a suitable organometallic precursor of the desired metal oxide, such as titania or silica, in the vapor state is permitted to flow through the deposition chamber by any suitable means. When the reagent flows into the deposition chamber it is decomposed to deposit a film of either titania or silica on the substrate. Individual layers of titania and silica can be uniformly deposited employing this process and have been successfully deposited on both flat and curved substrates such as lamp envelopes. Uniform layers of titania (or tantala) and silica can be formed ranging from about 100 to 100,000 Å in thickness. When the desired film thickness is achieved, the reagent flow is stopped, the chamber evacuated and the reagent for the other material is flowed into the deposition chamber until the desired thickness of that material is achieved. The process is repeated until the desired multiple layer optical interference coating or filter is formed.

Illustrative, but non-limiting examples of compounds suitable for use in the present invention for depositing a silica film from LPCVD include tetraethoxy silane, diacetoxy dibutoxy silane, tetraacetoxy silane and silicon tetrakis diethyloxyamine. Suitable reagents for use in the present invention useful for depositing a film of tantala employing LPCVD include tantalum ethoxide, tantalum isopropoxide, tantalum methoxide, tantalum butoxide, mixed tantalum alkoxides and tantalum pentachloride and water and/or oxygen. Titanium tetraethoxide, isopropoxide, isobutoxide and n-propoxide are suitable reagents for depositing titania and pentaethyl niobiate is useful for depositing niobia. No carrier gas is required in the deposition chamber to facilitate movement of the reagent through the chamber, although an inert carrier gas can also be employed, if desired. The pressure in the chamber during the deposition process will, in general, range between about 0.1-2.0 torr, depending upon the reagent used and the temperature of the substrate. The flow rate of the gaseous reagent in the deposition chamber will generally range between about 10-2,000 SCCM, depending upon the size of the reaction chamber, the reagent, presence of a carrier gas and desired rate of deposition, etc.

Another process which is possible to employ to apply an optical interference coating in a uniform manner to all of the interior surfaces of an all glass reflector is an aqueous process which is known to those skilled in the art and an example of which may be found in, i.e., U.S. Pat. No. 4,701,663. However, in an aqueous process the coating materials must be alternatively applied by spraying or dipping along with spinning and baking or drying in order to achieve uniform coating thicknesses and to enable successive alternating layers to be built up to obtain the film without diffusion of one material into the other. However, this process is extremely difficult to apply uniformly to a reflector and is very time consuming. Consequently, an LPCVD or chemical vapor deposition (CVD) process employing a suitable reagent in gaseous form which is decomposed on the surface of the substrate to be coated is the present state of technology most preferred as the method to apply the optical interference coating to the interior and/or exterior surfaces of the rear cavity portion of an all glass reflector in addition to the interior surface of the parabolic reflecting portion thereof.

The invention will be further understood by reference to the Example below.

EXAMPLE

An optical interference coating consisting of alternating layers of titania and silica for a total of thirty layers was applied by an LPCVD process as set forth above to an all glass reflector as depicted in FIG. 2(*a*), coating completly and continuously all of the interior and exterior surfaces thereof as shown in the figure. Titanium ethoxide was used as the precursor reagent for the titania and diacetoxy dibutoxy silane was used as the reagent for the silica. The total thickness of the optical interference coating was about 2700 nm and the coating was a cold mirror design reflecting about 95% of radiation having a wavelength between about 400-700 nm and transmitting in the infrared portion having a wavelength greater than about 800 nm. FIG. 4 illustrates the theoretical spectral reflectance and transmittance of this optical interference coating. It has been determined that having a coating on the exterior surface as well as the interior surfaces of the reflector increased the forward reflectance of visible light from about 400-700 nm by only about 1% as compared to that which would be achieved if only all of the interior surfaces were coated. Other reflectors were obtained which were coated by a proprietary physical vapor deposition (PVD) process which is a line-of-sight process wherein the optical interference coating consisted of alternating layers of silica and zinc sulfide and coated only the interior reflecting surface of the parabolic reflecting portion of the glass reflector as shown in FIG. 1. These were coated commercially by a proprietary prior art process. This coating was also a cold mirror design reflecting visible light in the 400-700 nm range and transmitting at least about 80% of the infrared radiation having a wavelength greater than about 900 nm. Both of these optical interference coatings were similar in reflecting across the visible portion of the spectrum (400-700 nm) and transmitting at least about 80% of the infrared (i.e., ≧900 nm).

Lamps were made from these reflectors by cementing 50 watt and 75 watt tungsten-halogen lamps into the rear cavity of both types of reflectors as is depicted in FIG. 3. All of the reflectors had the same dimensions (i.e., about 4½ cm wide at the open end of the reflecting portion and about 4 cm long, which includes the rear cavity projecting about 1¼ cm). The lamps were cemented into the reflector using an aluminum phosphate cement of the type disclosed in U.S. Pat. No. 4,833,576. Measurements were made of the relative intensity of light out of the back of both types of coated reflectors using a Minolta Model XY-1 light meter which is CIE adjusted to measure relative lumens in the visible range as illuminance value in lux. The meter was held at a distance of about 50 cm from the reflector and lamp assembly normal to the transverse axis and at an angle of about 20° off normal towards the rear of the reflector. The results of these measurements showed that the reflector and lamp combination having the prior art coating only on the interior surface of the parabolic reflecting portion gave out a relative amount of light of from about 120-200, whereas the reflector and lamp combination of the present invention in the embodiment wherein all the surfaces of the reflector were coated with the optical interference coating described above had a relative light output of only from about 16–20. This then was a factor of attenuation of approximately eight (8) comparing a reflector lamp combination of the present invention with that of the prior art with respect to the amount of light transmitted out through the back and rear cavity portion of the reflector.

Having a coating on the external surface of the reflector and particularly that of the rearwardly projecting lamp cavity does achieve some attenuation of light out the back. However, the exterior surface of most all glass reflectors is not made as a controlled reflecting surface and so with the example of the present invention previously described, less than 1% would be added to the forward reflected light projected out the front of the reflector in the visible spectrum of the wavelength of about 400–700 nm.

A lamp and reflector combination of the present invention described above having the thirty layer optical interference coating on all surfaces of the glass reflector and containing a 50 watt lamp was again measured with the Minolta meter to compare the amount of light transmitted out of the back of the reflector with that reflected and projected forward, both at a distance of 50 cm. The relative intensities were 47,000 lux out the front and only 14 lux out the back. Thus, the light transmitted through the reflector was only 0.1% of that projected out the front. In contrast, using the same type reflector coated only on the reflecting surface (FIG. 1) with the prior art silica/zinc sulfide coating described above with a 75 watt lamp in the reflector measured 53,500 lux out the front and 136 lux out the back. In this case the light out the back was 0.25% that of the front. At a distance of about 3 inches, the meter measured about 35 lux coming out of the back of the lamp and reflector combination of the invention and 180–300 lux with the reflector of the prior art.

Another advantage of the present invention is that the push strength or force required to push a cemented lamp out of the rear reflector cavity of a reflector coated according to the invention is substantially greater than that required with the same reflector coated only on the inside reflecting surface. Thus, with the two different types of reflector and lamp combinations described under the two preceding paragraphs and employing an aluminum phosphate cement disclosed in U.S. Pat. No. 4,833,576, the push strength for the present invention was at least 40% greater than that for the prior art combination. Even after a month under high humidity conditions the push strength for the present invention was 48 pounds compared to only 34 pounds for the prior art reflector.

Another significant advantage of the present invention over that of the prior art is the ability to control not only the relative intensity of the light out of the rear of the reflector but also the color, without adversely affecting either the color or intensity of the light reflected and projected forward of the reflector. Thus, reflectors coated on both sides with a silica/titania optical interference coating and containing lamps according to the present invention have been made which appear red, green or blue when viewed from the back or side with no adverse effect on the light reflected and projected forward of the reflector. This has been accomplished by changing the design of the optical interference coating. The thirty layer silica/titania coating described above and in FIG. 4 results in a blue appearance of a reflector coated on both sides and containing a lamp. The blue portion of the spectrum illustrated in FIG. 4 is from about 400–480 nm and the reflector containing an energized lamp appears blue when viewed from the side or rear due to the off angle shift which occurs in viewing which is not normal to the outer surface of the reflector.

What is claimed is:

1. A reflector made of light transparent material comprising a front reflecting portion having a light reflecting surface for projecting reflected light forward of said reflector and a rear portion terminating in an elongated, rearwardly protruding cavity wherein the interior surface of said cavity does not form part of said forward reflecting surface, said reflector being coated on said light reflecting surface and on the inside surface or outside surface of said cavity or both of said surfaces of said cavity with an optical interference coating which selectively reflects and transmits different portions of the electromagnetic spectrum.

2. The reflector of claim 1 wherein said coating is a multilayer coating comprising alternating layers of both high and low index of refraction materials.

3. The reflector of claim 2 wherein said coating is applied by an LPCVD coating process.

4. The reflector of claim 3 wherein said silica comprises said low index of refraction material.

5. The reflector of claim 4 wherein said high index of refraction material is selected from the group consisting essentially of titania, tantala and niobia.

6. The reflector of claim 1 having reduced light transmission through said nose portion.

7. The reflector of claim 6 wherein said coating transmits infrared radiation, but reflects visible light radiation.

8. The reflector of claim 2 wherein said coating is applied by either an LPCVD or a CVD coating process.

9. The reflector of claim 1 wherein said coating reflects at least 90% of visible light having a wavelength between 400–800 nm and transmits at least 80% of infrared radiation having a wavelength greater than 900 nm.

10. An all glass reflector comprising a front reflecting portion having a light reflecting surface for reflecting and projecting light forward of said reflector portion, said front reflecting portion terminating in an elongated, rearwardly protruding cavity for receiving a portion of a lamp wherein the interior surface of said cavity does not form part of said forward projecting light reflecting surface, said reflector being coated on its inside and outside surfaces, including both inside and outside surfaces of said cavity, with an optical interference coating for selectively reflecting and transmitting certain portions of the electromagnetic spectrum, wherein said coating comprises alternating layers of both high and low index of refraction materials.

11. The reflector of claim 10 wherein said low index of refraction material comprises silica.

12. The reflector of claim 11 wherein said high index of refraction material is selected from the group consisting essentially of titania, tantala and niobia.

13. The reflector of claim 12 wherein said coating reflects at least 90% of visible light having a wavelength between 400–800 nm and transmits at least 80% of infrared radiation having a wavelength greater than 900 nm.

14. The reflector of claim 12 wherein said coating is applied by a CVD or LPCVD coating process.

15. The reflector of claim 14 wherein said coating process is an LPCVD process.

16. The reflector of claim 15 wherein said high index of refraction material is titania.

17. The reflector of claim 16 wherein said coating transmits infrared radiation, but reflects visible light radiation.

18. The reflector of claim 15 having reduced light transmission through said rearwardly protruding cavity.

19. The reflector of claim 13 wherein said coating reflects at least 90% of visible light having a wavelength between 400–800 nm and transmits at least 80% of infrared radiation having a wavelength greater than 900 nm.

20. The reflector of claim 10 having reduced light transmission through said rearwardly protruding cavity.

21. In combination, an electric lamp and an all glass reflector comprising a front reflecting portion having a light reflecting surface for reflecting and projecting light forward of said reflector and a rear portion which comprises an elongated, rearwardly protruding cavity wherein the interior surface of said cavity does not form part of said forward projecting, light reflecting surface, wherein a portion of said lamp is held in said cavity and wherein said reflector is coated on said light reflecting surface and on the inside surface or outside surface of said cavity or both of said surfaces of said cavity with an optical interference coating for selectively reflecting and transmitting certain portions of the electromagnetic spectrum.

22. The combination of claim 21 wherein said coating is a multilayer coating comprising alternating layers of both high and low index of refraction materials.

23. The combination of claim 22 having reduced light transmission through said rearwardly protruding cavity of said reflector.

24. The combination of claim 22 wherein said low index of refraction material comprises silica.

25. The combination of claim 24 wherein said coating is on both the inside and outside surfaces of said reflector.

26. The combination of claim 25 wherein said higher index of refraction material is selected from the group consisting essentially of titania, tantala and niobia.

27. The combination of claim 26 wherein visible light is reflected and infrared radiation is transmitted through said reflector.

28. The combination of claim 27 wherein said light transmitted through said reflector is of a color different from the reflected and projected forward of said reflector.

29. The combination of claim 28 having reduced light transmission through said rearwardly protruding cavity of said reflector.

30. The combination of claim 21 wherein said coating is on both the inside and outside surfaces of said reflector.

31. The combination of claim 21 wherein said coating reflects at least 90% of visible light having a wavelength between 400–800 nm and transmits at least 80% of infrared radiation having a wavelength greater than 900 nm.

32. In combination, an all glass reflector comprising a front parabolic reflecting portion having a light reflecting surface for reflecting and projecting light forward of said reflector and a rear portion which comprises an elongated, rearwardly protruding cavity and an electric lamp, a portion of which is held in said cavity, wherein said reflector is coated on both its interior and exterior surfaces with a multi-layer optical interference coating comprising alternating layers of high and low index of refraction materials for selectively reflecting and transmitting certain portions of the electromagnetic spectrum, thereby reducing visible transmission through said rear portion, said interior surface of said cavity not being part of said forward projecting light reflecting surface.

33. The combination of claim 32 having reduced light transmission through said rearwardly protruding cavity of said reflector.

* * * * *